US011426779B2

(12) United States Patent
Niinomi

(10) Patent No.: US 11,426,779 B2
(45) Date of Patent: Aug. 30, 2022

(54) METHOD OF MANUFACTURING PIPE

(71) Applicant: FUTABA INDUSTRIAL CO., LTD., Okazaki (JP)

(72) Inventor: Hirotaka Niinomi, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

(21) Appl. No.: 17/030,963

(22) Filed: Sep. 24, 2020

(65) Prior Publication Data

US 2021/0129200 A1 May 6, 2021

(30) Foreign Application Priority Data

Oct. 30, 2019 (JP) ..... JP2019-197191

(51) Int. Cl.
*B21D 7/06* (2006.01)
*B21D 5/08* (2006.01)
*B21D 5/10* (2006.01)

(52) U.S. Cl.
CPC ..... *B21D 7/06* (2013.01); *B21D 5/083* (2013.01); *B21D 5/10* (2013.01)

(58) Field of Classification Search
CPC ..... B21D 5/06; B21D 5/08; B21D 5/083; B21D 5/10; B21D 5/12
See application file for complete search history.

(56) References Cited

U.S. PATENT DOCUMENTS 4,603,806 A 8/1986 Watanabe et al.
7,418,849 B2 * 9/2008 Hauger ..... B21D 5/083 72/367.1
7,637,135 B2 * 12/2009 Homig ..... B21C 37/065 72/367.1

(Continued)

FOREIGN PATENT DOCUMENTS

CN 104364027 A 2/2015
CN 106715000 A 5/2017

(Continued)

OTHER PUBLICATIONS

Notice of Reasons for Refusal for Japanese Patent Application No. 2019197191, dated Sep. 14, 2021, 8 pages including English translation.

(Continued)

*Primary Examiner* — Teresa M Ekiert
(74) *Attorney, Agent, or Firm* — Withrow & Terranova, P.L.L.C.; Vincent K. Gustafson

(57) ABSTRACT

Provided is a method of manufacturing a pipe including a large-diameter portion, a small-diameter portion, and a reduced diameter portion connecting the large-diameter portion and the small-diameter portion, the method comprising: forming a metal plate member into a U-shaped member having a U-shaped cross section; and forming the U-shaped member into a shape of the pipe. The U-shaped member includes: a curved portion facing an opening between both edges of the U-shaped cross section; and two facing side walls continued from the curved portion. An opening degree (Continued)

of the two facing side walls in a portion to form the small-diameter portion is larger than an opening degree of the two facing side walls in a portion to form the large-diameter portion.

2 Claims, 13 Drawing Sheets

(56) References Cited

U.S. PATENT DOCUMENTS

| | | | | |
|---|---|---|---|---|
| 9,327,327 | B2 * | 5/2016 | Shinmiya ..... | B21D 5/015 |
| 2005/0257591 | A1 | 11/2005 | Hauger et al. | |
| 2015/0165503 | A1 | 6/2015 | Shinmiya et al. | |
| 2017/0274434 | A1 | 9/2017 | Sato et al. | |

FOREIGN PATENT DOCUMENTS

| | | | |
|---|---|---|---|
| JP | H03291115 | A | 12/1991 |
| JP | 201659938 | A | 4/2016 |
| JP | 6327319 | B2 | 5/2018 |
| JP | 201879494 | A | 5/2018 |

OTHER PUBLICATIONS

First Office Action for Chinese Patent Application No. 202011171291.2, dated Jul. 5, 2022, 12 pages.

* cited by examiner

METHOD OF MANUFACTURING PIPE

CROSS-REFERENCE TO RELATED APPLICATIONS

This application claims the benefit of Japanese Patent Application No. 2019-197191 filed on Oct. 30, 2019 with the Japan Patent Office, the entire disclosure of which is incorporated herein by reference.

BACKGROUND

The present disclosure relates to a method of manufacturing a pipe.

A pipe is known in which a large-diameter portion and a small-diameter portion are arranged along a longitudinal direction, and a reduced diameter portion is formed between the large-diameter portion and the small-diameter portion so as to be tapered from the large-diameter portion toward the small-diameter portion.

Japanese Patent No. 6327319 discloses a method of manufacturing a metal pipe by a UO bending method, the metal pipe having a large-diameter straight portion, a small-diameter straight portion, and a cone-shaped portion connecting the both straight portions. The UO bending method is a method of manufacturing a pipe, and includes a U-shape bending step to bend a flat metal plate to have a U-shaped cross-section and an O-shape bending step to bend two edges (facing areas) of the U-bent metal plate so that both facing areas face each other, thereby forming a pipe shape. The flat metal plate includes a first portion having a substantially uniform plate width to form the large-diameter straight portion, a second portion having a tapered plate width to form the cone-shaped portion continued from the first portion, and a third portion having a substantially uniform plate width to form the small-diameter straight portion continued from the second portion.

SUMMARY

Depending on the purpose of use of the above-described pipe, there has been a demand to shorten the reduced diameter portion. However, as a result of detailed study, the inventor found that buckling is likely to occur in the large-diameter portion when the reduced diameter portion is shortened. The reasons are as follows.

When the pipe including the large-diameter portion, the small-diameter portion and the reduced diameter portion is manufactured by the UO bending method as disclosed in Japanese Patent No. 6327319, the portion of the metal plate member to form the reduced diameter portion has a trapezoid shape. In the trapezoid portion, a length along an edge of the facing area is longer than a length in a central portion in an axial direction. Thus, in the O-shape bending, the plate material includes excess in the facing areas of the reduced diameter portion, and such excess flows into the large-diameter portion, and thus, buckling may occur in the large-diameter portion.

When the reduced diameter portion is formed short, in the trapezoid portion of the metal plate member, the length along the edge of the facing area is much longer than the length of the central portion in the axial direction. Thus, in the O-shape bending, the plate material may include more excess in the facing areas of the reduced diameter portion; thus, buckling may easily occur in the large-diameter portion. The buckling may deteriorate the pipe strength because the pipe is easily broken at the bucking portion by an impact. Also, the buckling may make a welding process difficult.

In one aspect of the present disclosure, it is preferable to provide a technique to inhibit the occurrence of the buckling in the large-diameter portion in manufacturing the pipe by the UO bending method.

One aspect of the present disclosure is a method of manufacturing a pipe including a large-diameter portion, a small-diameter portion, a reduced diameter portion connecting the large-diameter portion and the small-diameter portion, the method comprising a step of forming a metal plate member into a U-shaped member having a U-shaped cross section, and a step of forming the U-shaped member into a pipe shape. The U-shaped member includes: a curved portion facing an opening between both edges of the U-shaped cross section; and two side walls continued from the curved portion. In the U-shaped member, an opening degree of the two facing side walls in a portion to form the small-diameter portion is larger than an opening degree of the two facing side walls in a portion to form the large-diameter portion.

This configuration allows to inhibit the occurrence of the buckling in the large-diameter portion in manufacturing the pipe by the UO bending method.

In one aspect of the present disclosure, the metal plate member may include a wide width portion, a narrow width portion, and a reduced width portion. The wide width portion is a portion to form the large-diameter portion. The narrow width portion is a portion to form the small-diameter portion and the narrow width portion has a plate width shorter than a plate width of the wide width portion. The reduced width portion is a portion to form the reduced diameter portion, and the reduced width portion has a plate width that varies to connect the wide width portion and the narrow width portion.

This configuration allows to inhibit the occurrence of the buckling in the large-diameter portion in manufacturing the pipe, by the UO bending method, from the metal plate member including the wide width portion, the narrow width portion, and the reduced width portion.

In one aspect of the present disclosure, in the U-shaped member, the two facing side walls in the portion to form the small-diameter portion, and the two facing side walls in the portion to form the large-diameter portion may be flat.

This configuration allows to inhibit the occurrence of the buckling in the large-diameter portion when the pipe is manufactured from the U-shaped member in which the two facing side walls are flat in the portion to form the small-diameter portion and in the portion to form the large-diameter portion.

In one aspect of the present disclosure, the pipe may be used for an instrument panel reinforcement of a vehicle.

This configuration allows to inhibit the occurrence of the buckling in the large-diameter portion. Thus, it is possible to manufacture a pipe that has a short reduced diameter portion and that is used for the instrument panel reinforcement.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. Configuration

Figure 1:
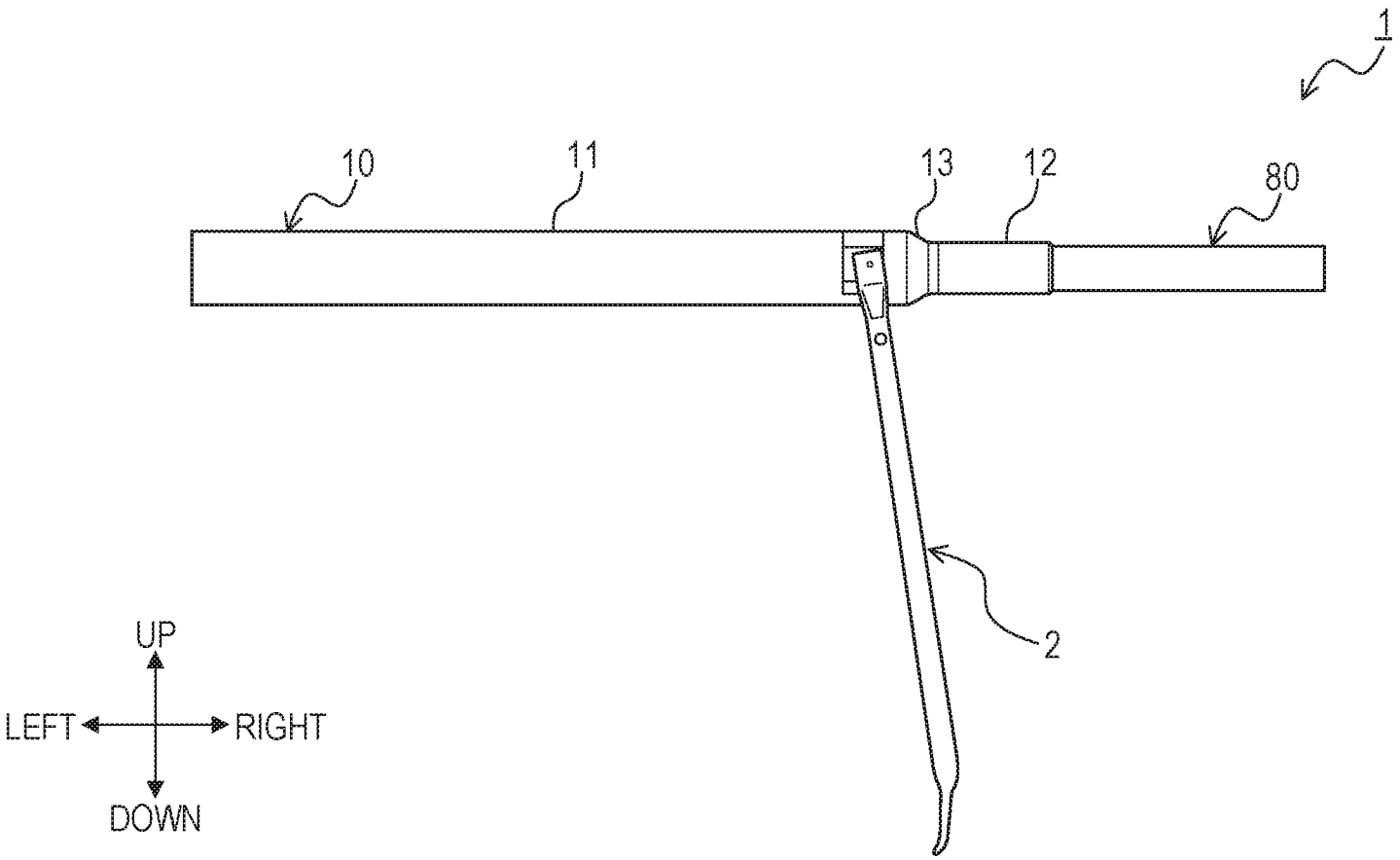
FIG. 1 is a front view showing a structure of an instrument panel reinforcement using a pipe according to an embodiment.

As shown in FIG. 1, a pipe 10 as one example of the present embodiment is used for an instrument panel reinforcement 1. The instrument panel reinforcement 1 is a long cylindrical component arranged along a width direction of a vehicle in an instrument panel of the vehicle. The instrument panel reinforcement 1 is configured to support a steering column and the instrument panel and also configured to serve as occupant protection at the time of collision.

FIG. 1 is a view of the instrument panel reinforcement 1 arranged in the vehicle, as seen from a driver's side. In FIG. 1, a right-left direction and an up-down direction of the vehicle are indicated by arrows. The right-left direction indicates a width direction of the vehicle, and the up-down direction indicates a height direction of the vehicle. Here, the vehicle means a left-hand drive vehicle.

The instrument panel reinforcement 1 includes the pipe 10 and a pipe 80. The instrument panel reinforcement 1 includes a framework bracket 2 attached thereto. The upper end of the framework bracket 2 is connected to the pipe 10, and the lower end thereof is fixed to an underbody of the vehicle. The instrument panel reinforcement 1 is supported by the framework bracket 2 from the lower side of the vehicle. The instrument panel reinforcement 1 includes various components attached thereto besides the framework bracket 2; however, these components are not shown in FIG. 1.

Figure 2:
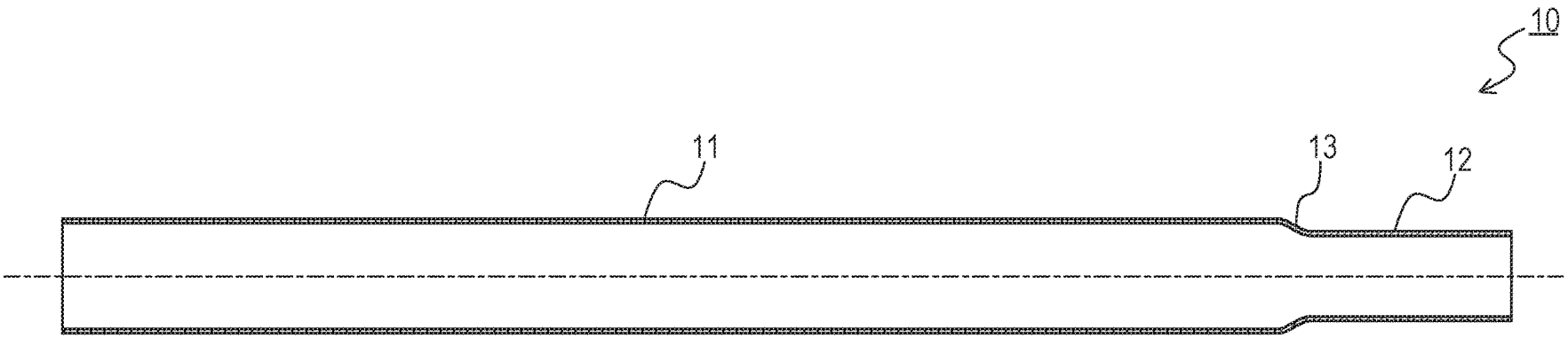
FIG. 2 is a front view of the pipe according to the embodiment.

As shown in FIG. 2, the pipe 10 as a whole is formed into a cylindrical shape. The sectional shape of the pipe 10 is a perfect circle. Here, the term "perfect circle" does not necessarily mean an exact perfect circle, but it means a classification different from an oval. The pipe 10 includes a large-diameter portion 11, a small-diameter portion 12, and a reduced diameter portion 13. The large-diameter portion 11 is a portion having a substantially uniform outer diameter. The small-diameter portion 12 is a portion also having a substantially uniform outer diameter. The small-diameter portion 12 has an outer diameter that is smaller than that of the large-diameter portion 11. The reduced diameter portion 13 is a portion connecting the large-diameter portion 11 and the small-diameter portion 12. The outer diameter of the reduced diameter portion 13 is gradually reduced from the side of the large-diameter portion 11 toward the side of the small-diameter portion 12. As one example, the outer diameter of the reduced diameter portion 13 is reduced at a constant rate. Thus, the reduced diameter portion 13 looks like a trapezoid when the pipe 10 is seen from a direction perpendicular to an axial direction of the pipe 10. As one example, the pipe 10 has a uniform thickness in the large-diameter portion 11, small-diameter portion 12 and the reduced diameter portion 13.

In FIG. 2, the central axis of the pipe 10 is indicated by a dash-dotted line. The pipe 10 is a concentric pipe in which the central axes of the large-diameter portion 11, the small-diameter portion 12 and the reduced diameter portion 13 are positioned on the same straight line.

As shown in FIG. 1, the instrument panel reinforcement 1 is formed by connecting the pipe 10 and the pipe 80. The pipe 10 is arranged in the instrument panel reinforcement 1 such that the large-diameter portion 11 is positioned on the left side, and the small-diameter portion 12 is positioned on the right side. The pipe 80 has a substantially uniform outer diameter. The outer diameter of the pipe 80 is smaller than the inner diameter of the small-diameter portion 12. The pipe 10 and the pipe 80 are connected by inserting the left end of the pipe 80 into the right end of the pipe 10 and performing welding or the like.

Next, a method of manufacturing the pipe 10 is described with reference to FIG. 3 to FIG. 10.

Figure 3:
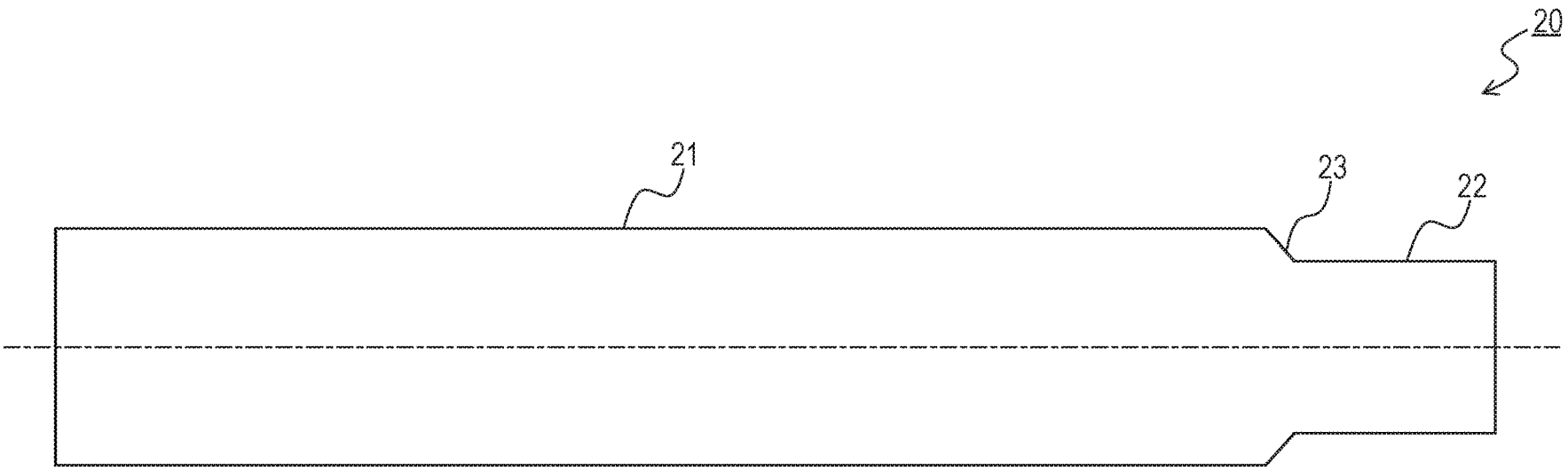
FIG. 3 is a plane view of a metal plate member.

The pipe 10 is manufactured by press-molding a metal plate member 20 shown in FIG. 3 by a below-described UO bending method. In FIG. 3, a center line along the axial direction of the pipe 10 in the metal plate member 20 is indicated by a dash-dotted line.

Figure 4:
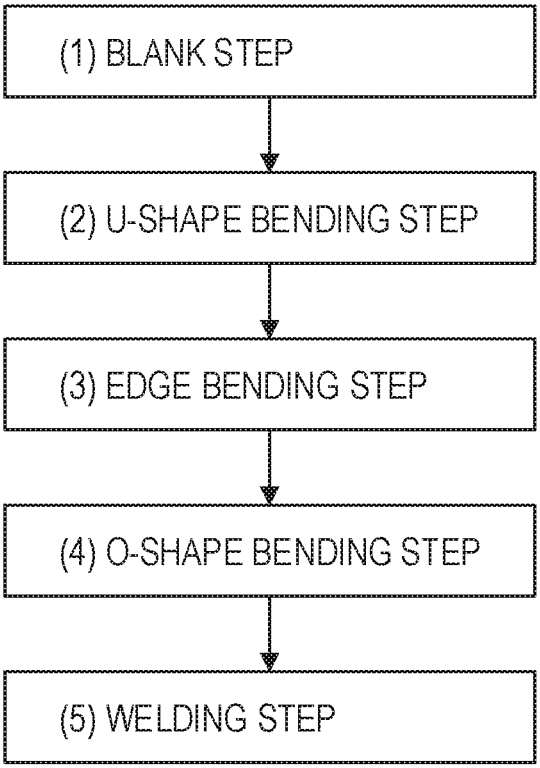
FIG. 4 is a flow diagram showing each step of a method of manufacturing the pipe according to the embodiment.

The UO bending method includes, as shown in FIG. 4, (1) a blank step, (2) a U-shape bending step, (3) an edge bending step, (4) an O-shape bending step, and (5) a welding step. Numbers (1) to (5) indicate the order of the manufacturing steps shown in FIG. 4.

Figure 5:
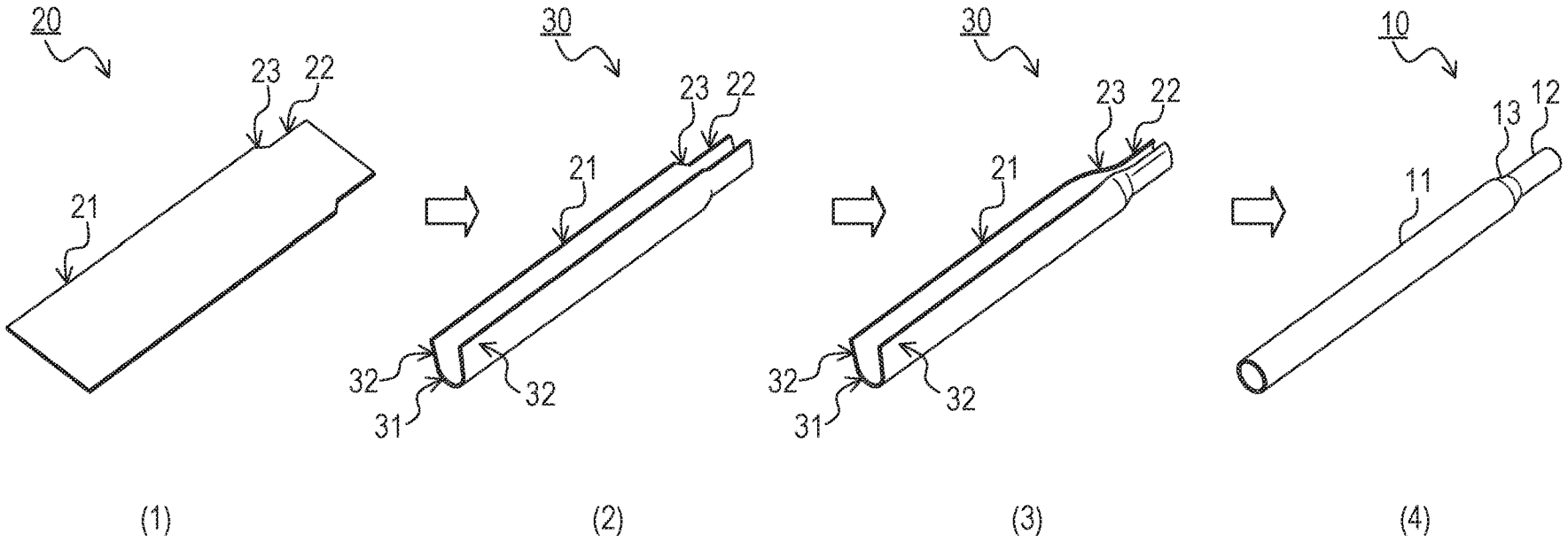
FIG. 5 includes perspective views showing the metal plate member, a U-shaped member or the pipe in each step in the method of manufacturing the pipe according to the embodiment.
Figure 6:
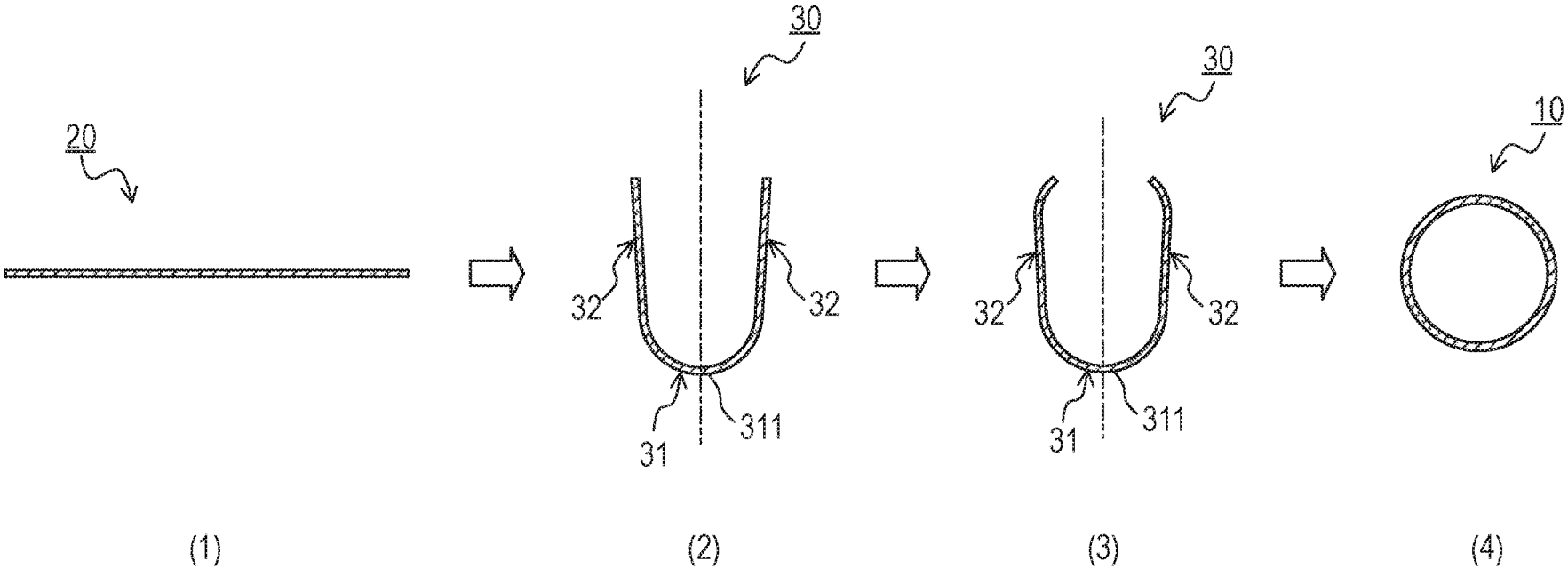
FIG. 6 includes sectional views showing the metal plate member, the U-shaped member or the pipe in each step in the method of manufacturing the pipe according to the embodiment.

The illustrations (1) to (4) in FIG. 5 respectively correspond to the manufacturing steps (1) to (4). FIG. 5 shows perspective views of the metal plate member 20, a U-shaped member 30, or the pipe 10 in the corresponding manufacturing step. The illustrations (1) to (4) in FIG. 6 correspond to the manufacturing steps (1) to (4). FIG. 6 shows sectional views, which are taken along a plane perpendicular to the axial direction of the pipe 10, of the metal plate member 20, the U-shaped member 30, or the pipe 10 in the corresponding manufacturing step.

(1) Blank Step

In the blank step, the metal plate member 20 having a flat shape shown in FIG. 3 and FIG. 5 (1) is cut out from a flat metal material.

The metal plate member 20 includes a wide width portion 21, a narrow width portion 22, and a reduced width portion 23. The wide width portion 21 is a portion to form the large-diameter portion 11. The narrow width portion 22 is a portion to form the small-diameter portion 12. The reduced width portion 23 is a portion to form the reduced diameter portion 13.

The wide width portion 21 is a portion having a substantially uniform plate width. Here, the plate width is a length of the metal plate member 20 in a direction perpendicular to the center line along the axial direction of the pipe 10. The narrow width portion 22 is a portion also having a substantially uniform plate width. The plate width of the narrow width portion 22 is shorter than the plate width of the wide width portion 21. The reduced width portion 23 is a portion having a plate width that varies so as to connect the wide width portion 21 and the narrow width portion 22. That is, the plate width of the reduced width portion 23 is gradually reduced from the side of the wide width portion 21 toward the side of the narrow width portion 22. As one example, the plate width of the reduced width portion 23 is reduced at a constant rate. Thus, both edges of the reduced width portion 23 are straight.

(2) U-shape Bending Step

Figure 7B:
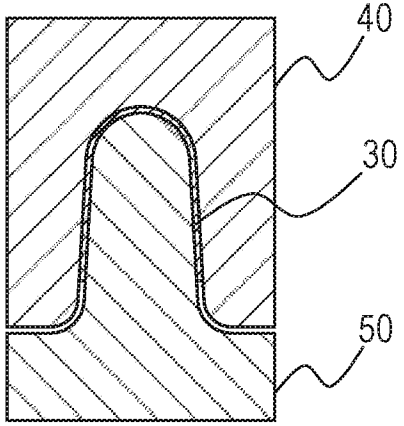
FIG. 7B is a sectional view showing the die, the punch and the U-shaped member after the U-shape bending step.
Figure 7A:
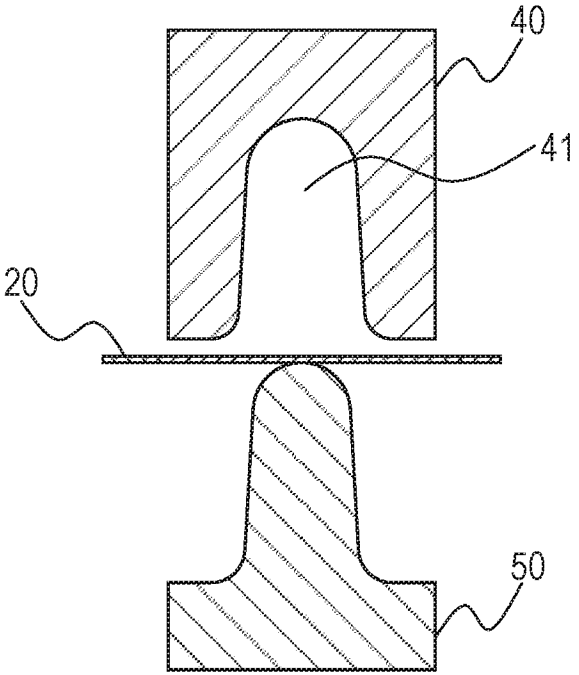
FIG. 7A is a sectional view showing a die, a punch and the metal plate member before a U-shape bending step.

In the U-shape bending step, by press molding shown in FIG. 7A and FIG. 7B, the metal plate member 20 is bent into a U-shape.

The U-shape bending is performed by press molding with a die 40 and a punch 50 shown in FIG. 7A and FIG. 7B. The punch 50 has a convex portion curved into the U-shape. The die 40 has a concave frame mold 41 curved into the U-shape, and the convex portion of the punch 50 is engaged with the frame mold 41. The convex portion of the punch 50 and the frame mold 41 of the die 40 are formed into a long shape along the axial direction of the pipe 10. FIG. 7A and FIG. 7B illustrate the die 40 and the punch 50 and the like in a sectional view taken along a plane perpendicular to the axial direction of the pipe 10.

Figure 9:
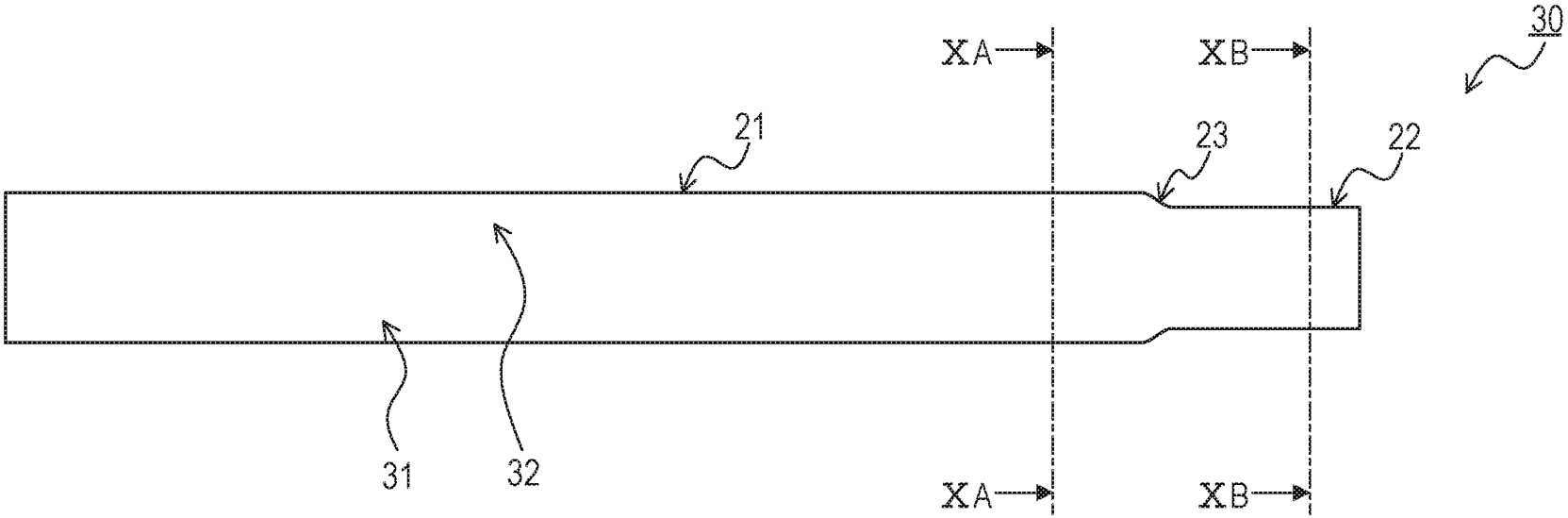
FIG. 9 is a view of the U-shaped member after the U-shape bending step, as seen from the side of a side wall.

When the U-shape bending is performed, first, as shown in FIG. 7A, the metal plate member 20 is placed on the punch 50. Then, as shown in FIG. 7B, the convex portion of the punch 50 is pushed into the frame mold 41 of the die 40 together with the metal plate member 20. The metal plate member 20 is then bent to have a U-shaped cross-section, and the U-shaped member 30 shown in FIG. 5 (2) is formed. The U-shaped member 30 has, as shown in FIG. 6 (2), the U-shaped cross section. The metal plate member 20 is bent into the U-shape so that the center line shown by the dash-dotted line in FIG. 3 comes at the bottom (a below-described bottom point 311) in the U-shaped cross section of the U-shaped member 30. Also, the metal plate member 20 is bent into the U-shape so that the center lines of the wide width portion 21, the narrow width portion 22 and the reduced width portion 23, which are along the axial direction of the pipe 10, are placed on an approximately identical line when the U-shaped member 30 is seen from the side of a below-described side wall 32, as shown in FIG. 9. The forming method is not limited to this. For example, the punch and the die may be inverted.

The U-shaped member 30 includes, as shown in FIG. 5 (2) and FIG. 6 (2), a curved portion 31 facing an opening between both edges of the U-shaped cross section, and two side walls 32 continued from the curved portion 31. In the U-shaped cross section, a point in the curved portion 31 farthest from the opening is referred to as the bottom point 311, and a virtual line passing through the center of the opening and the bottom point 311 is referred to as a center line of a U-shape. In FIG. 6 (2) and (3), the center line of the U-shape is shown by a dash-dotted line. The U-shaped cross section has an approximately line-symmetric shape with the center line of the U-shape as an axis of symmetry.

Each of the two side walls 32 is flat in the wide width portion 21 and in the narrow width portion 22. That is, the two side walls 32 have flat surfaces facing each other in the wide width portion 21 and in the narrow width portion 22. As shown in FIG. 6 (2), each of the two side walls 32 is straight when seen in the U-shaped cross section.

An opening degree formed by the two side walls 32 is different in the wide width portion 21 and in the narrow width portion 22. As one example, the opening degree of the two side walls 32 is an angle formed by the facing flat surfaces. That is, the larger the angle is formed by the facing flat surfaces, the larger the opening degree of the two side walls 32 becomes. When the facing flat surfaces are parallel, the angle is 0°. The opening degree of the two side walls 32 in the wide width portion 21 and the opening degree of the two side walls 32 in the narrow width portion 22 will be described with reference to FIG. 10A, FIG. 10B and FIG. 10C.

Figure 10C:
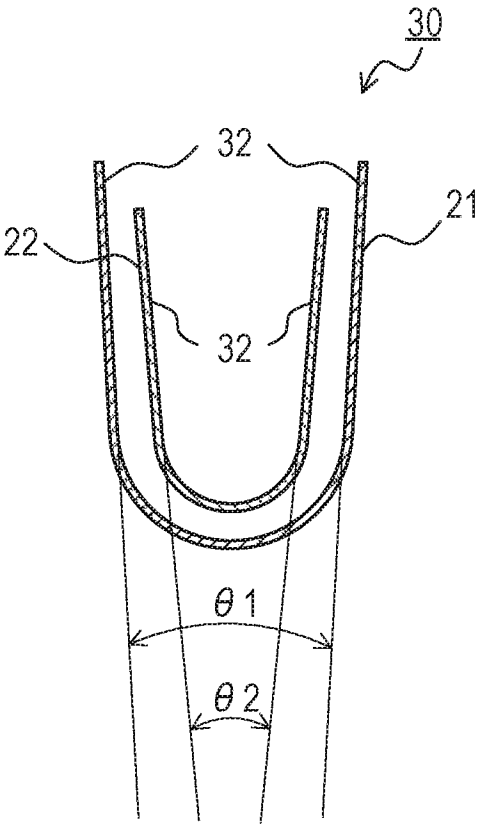
FIG. 10C is a view in which the sectional views of FIG. 10A and FIG. 10B are overlapped.
Figure 10B:
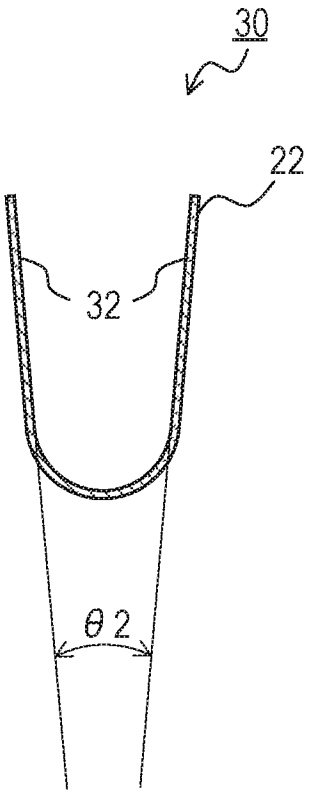
FIG. 10B is a sectional view taken from a line XB-XB of FIG. 9.
Figure 10A:
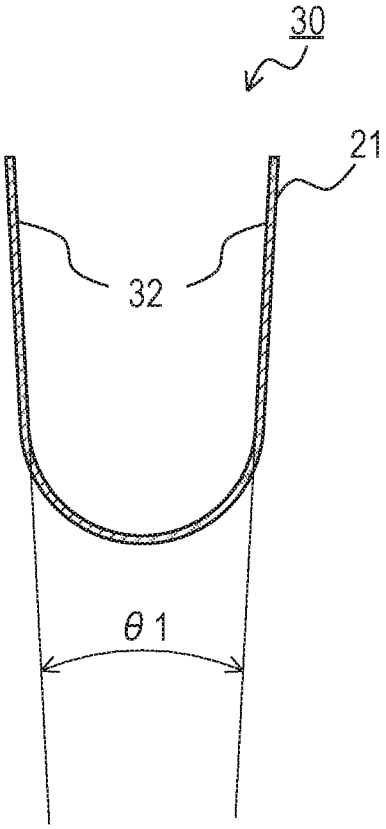
FIG. 10A is a sectional view taken from a line XA-XA of FIG. 9.

FIG. 10A is a sectional view showing only a cross-section taken from a line XA-XA of FIG. 9, and FIG. 10B is a sectional view showing only a cross-section taken from a line XB-XB of FIG. 9. That is, FIG. 10A illustrates a U-shaped cross section in the wide width portion 21, and FIG. 10B illustrates a U-shaped cross section in the narrow width portion 22. In the wide width portion 21 and the narrow width portion 22, the two side walls 32 are outwardly inclined from a position where the two facing flat surfaces are arranged in parallel.

The opening degree of the two side walls 32 in the narrow width portion 22 is larger than the opening degree of the two side walls 32 in the wide width portion 21. This will be explained below.

As shown in FIG. 10A, an angle formed by the facing flat surfaces in the wide width portion 21 is denoted by θ1. As shown in FIG. 10B, an angle formed by the facing flat surfaces in the narrow width portion 22 is denoted by θ2. In FIG. 10C, FIG. 10A and FIG. 10B are overlapped with each other to obtain an actual positional relationship between the U-shaped cross section of the wide width portion 21 and U-shaped cross section of the narrow width portion 22 when the U-shaped cross sections are seen from the axial direction of the pipe 10.

As shown in FIG. 10C, the angle θ2 formed by the facing flat surfaces in the narrow width portion 22 is larger than the angle θ1 formed by the facing flat surfaces in the wide width portion 21. That is, the opening degree of the two side walls 32 in the narrow width portion 22 is larger than the opening degree of the two side walls 32 in the wide width portion 21.

The opening degree of the two side walls 32 is adjustable by designing an inclination angle of the convex portion of the punch 50 and the frame mold 41 of the die 40. For example, the inclination angle of the convex portion of the punch 50 and the frame mold 41 of the die 40 to press mold the narrow width portion 22 may be designed to be larger than the inclination angle of the portions to press mold the wide width portion 21. This allows to form a U-shaped member 30 in which the opening degree of the two side walls 32 in the narrow width portion 22 is larger than than the opening degree of the two side walls 32 in the wide width portion 21 by use of the punch 50 and the die 40.

(3) Edge Bending Step

In the edge bending step, as shown in FIG. 5 (3) and FIG. 6 (3), an edge-bending is performed on the U-shaped member 30.

The edge-bending is performed by inwardly inclining and bending edges of the U-shaped member 30 in a part of the wide width portion 21 adjacent to the reduced width portion 23, in the reduced width portion 23 and in the narrow width portion 22. That is, both edges, parallel to the axial direction of the pipe 10, in a part of the wide width portion 21 adjacent to the reduced width portion 23, in the reduced width portion 23, and in the narrow width portion 22, are bent inside the U-shaped member 30. The both edges of the U-shaped member 30 parallel to the axial direction of the pipe 10 are portions to be faced each other in a below-described O-shape bending; thus, hereinafter, the both edges are referred to as facing areas. The edge-bending is performed by press molding by use of, for example, a punch having a shape in which the edge of the U-shape is inclined inside, and a frame mold having a shape corresponding to the punch.

By performing the edge-bending, stiffness of the facing areas in the U-shaped member 30 improves, and the movement of the material is inhibited; thus, wrinkles are hardly generated in the reduced diameter portion 13 during the bending of the U-shaped member 30 into an O-shape in the below-described O-shape bending step. In one example of the present embodiment, the edge-bending is performed on the reduced width portion 23 that is a portion to form the reduced diameter portion 13 where wrinkles are likely to generate, and on the neighboring narrow width portion 22 and on a part of the wide width portion 21 adjacent to the reduced width portion 23. Thus, the wrinkles are less generated in the reduced diameter portion 13 during the O-shape bending.

(4) O-Shape Bending Step

Figure 8B:
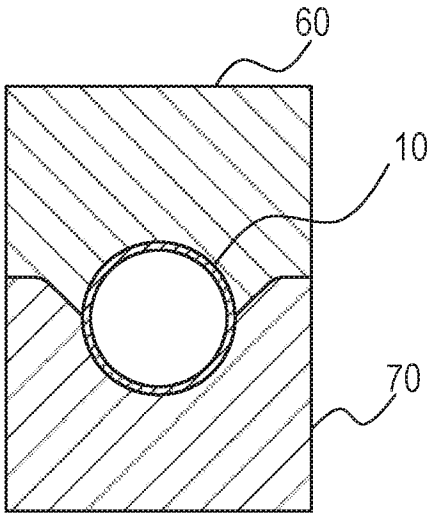
FIG. 8B is a sectional view showing the die and a pipe after the O-shape bending step.
Figure 8A:
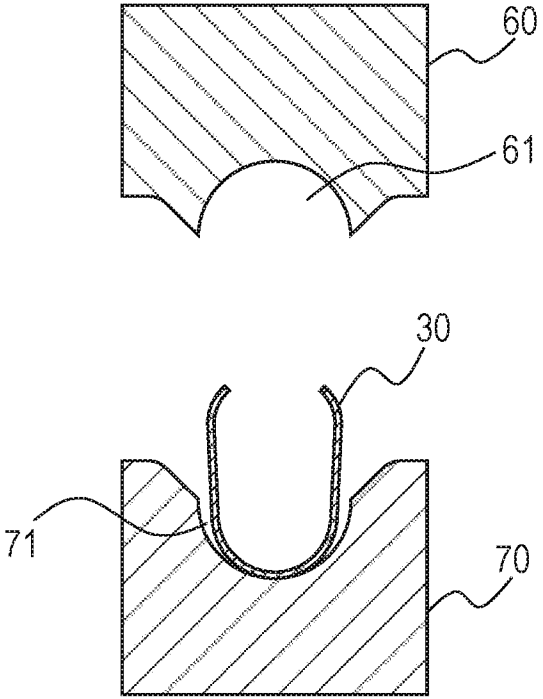
FIG. 8A is a sectional view showing a die and the U-shaped member before an O-shape bending step.

In the O-shape bending step, the U-shaped member 30 after the edge-bending is bent into the O-shape by press molding shown in FIG. 8A and FIG. 8B, thereby forming the pipe 10.

The O-shape bending is performed by press molding with a die 60 and a die 70 shown in FIG. 8A and FIG. 8B. The die 60 includes a frame mold 61 formed into a shape of an upper part of the pipe 10. The die 70 includes a frame mold 71 formed into a shape of a lower part of the pipe 10. The frame mold 61 and the frame mold 71 are formed into a long shape along the axial direction of the pipe 10. FIG. 8A and FIG. 8B illustrate the die 60, the die 70 and the like in a sectional view taken along a plane perpendicular to the axial direction of the pipe 10.

When the O-shape bending is performed, first, the U-shaped member 30 after the edge-bending is placed on the lower die 70 so as to be placed in the frame mold 71. Next, the die 70 is covered with the die 60 so that the U-shaped member 30 is placed in the frame mold 61. Then, the facing areas of the U-shaped member 30 including the edge-bent portions face each other, and the U-shaped member 30 is formed into the O-shape in its cross-section, thereby forming the pipe 10 shown in FIG. 5 (4).

(5) Welding Step

In the welding step, the facing areas of the U-shaped member 30, which are brought to face each other by the O-shape bending, are welded. When the welding is finished, the pipe 10 is finally manufactured.

2. Effects

According to the above-described embodiment, following effects can be obtained.

(2a) In the U-shaped member 30, the opening degree of the two side walls 32 in the narrow width portion 22 is larger than the opening degree of the two side walls 32 in the wide width portion 21. Thus, in comparison with the case where the opening degree of the two side walls in the narrow width portion and the opening degree of the two side walls in the wide width portion are the same, the length of the both edges substantially parallel in the axial direction of the pipe 10 in the reduced width portion 23, that is, the length of the side edge of the reduced width portion 23 is shorter in the U-shaped member 30. This will be explained with reference to FIG. 11A and FIG. 11B.

Figure 11B:
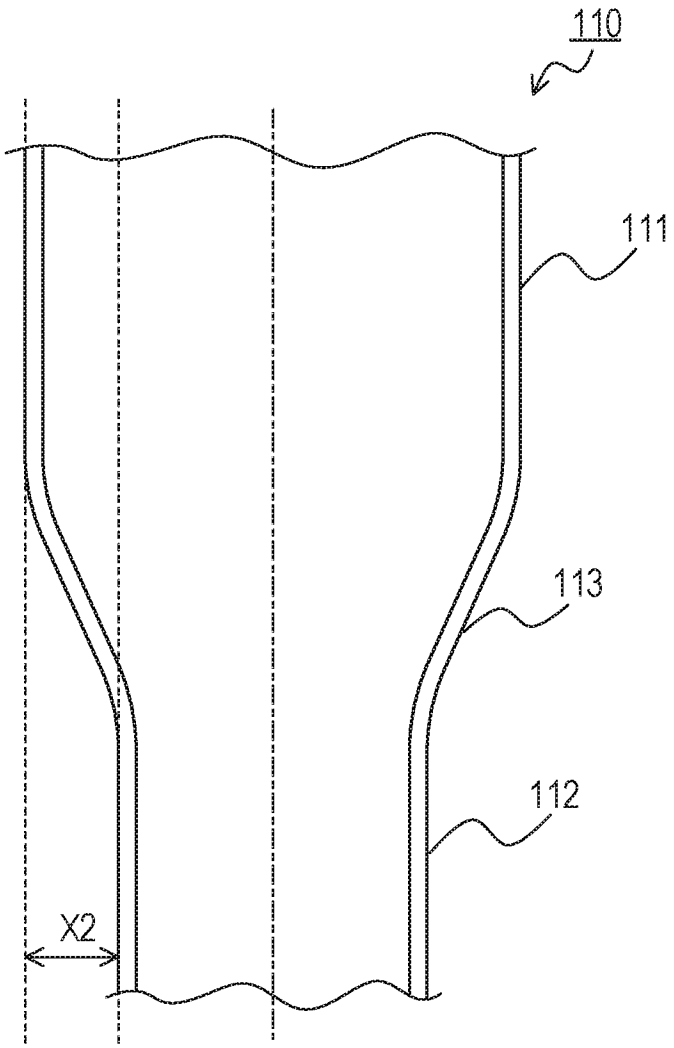
FIG. 11B is a plane view of a U-shaped member according to a comparative example, as seen from the opening side.
Figure 11A:
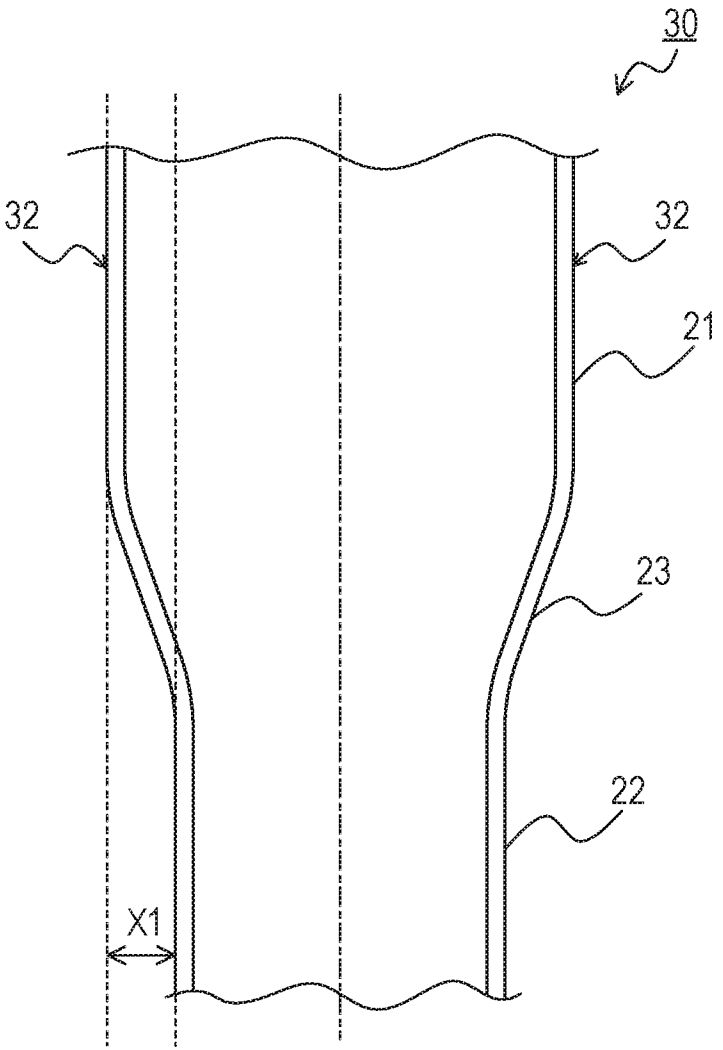
FIG. 11A is a plane view of the U-shaped member according to the embodiment, as seen from an opening side.

FIG. 11A is a plane view of the U-shaped member 30, as seen from the side of the opening. FIG. 11B is a plane view of a U-shaped member 110, as seen from the opening side. The U-shaped member 110 is a comparative example. In FIG. 11A and FIG. 11B, a center line along a pipe axial direction of the U-shaped member in the plane view is shown by a dash-dotted line.

In the U-shaped member 110, the opening degree of the two side walls in a narrow width portion 112 and the opening degree of the two side walls in a wide width portion 111 are the same. The U-shaped member 30 and the U-shaped member 110 are formed by bending the same metal plate member 20 into the U-shape, and only the opening degrees of the two side walls are different.

FIG. 11A shows X1 that is a difference in the U-shaped member 30 between a distance from the center line to the side edge of the wide width portion 21 in a plane view and a distance from the center line to the side edge of the narrow width portion 22 in the plane view (hereinafter, it is referred to as "a distance difference X1 between the wide width portion and the narrow width portion"). Also FIG. 11B shows X2 that is a difference in the U-shaped member 110 between a distance from the center line to the side edge of the wide width portion 111 in the plane view and a distance from the center line to the side edge of the narrow width portion 112 in the plane view (hereinafter, it is referred to as "a distance difference X2 between the wide width portion and the narrow width portion"). Here, the distance means the shortest distance.

As in the case of the U-shaped member 30, in which the opening degree of the two side walls 32 in the narrow width portion 22 is larger than the opening degree of the two side walls 32 in the wide width portion 21, the difference X1 between the wide width portion and the narrow width portion is smaller than the difference X2 between the wide width portion and the narrow width portion as in the case of the U-shaped member 110, in which the opening degree of the two side walls of the narrow width portion 112 is the same as the opening degree of the two side walls of the wide width portion 111.

The side edge of the reduced width portion connects the side edge of the wide width portion and the side edge of the narrow width portion. Thus, in the plane view where the U-shaped member is seen from the opening side, the smaller the difference between the wide width portion and the narrow width portion is, the shorter the length of the side edge of the reduced width portion becomes. The distance difference X1 between the wide width portion and the narrow width portion in the U-shaped member 30 is smaller than the distance difference X2 between the wide width portion and the narrow width portion in the U-shaped member 110. Thus, in the plane view, the length of the side edge of the reduced width portion 23 of the U-shaped member 30 is shorter than the length of the side edge of the reduced width portion 113 of the U-shaped member 110.

Here, for easier understanding, the plane view in which the U-shaped member 30 is seen from the side of the opening is used to explain that the length of the side edge of the reduced width portion 23 is shorter. However, in a practical manner, the opening degree of the two side walls 32 in the narrow width portion 22 and the opening degree of the two side walls 32 in the wide width portion 21 in the U-shaped member 30 are designed so that the length of the side edge of the reduced width portion 23 is short in a three dimensional shape.

In this way, the method of manufacturing the pipe 10 as described above allows to shorten the side edge of the reduced width portion 23 in the U-shaped member 30 compared to the method of forming the U-shaped member in which the opening degree of the two side walls in the narrow width portion and the opening degree of the two side walls in the wide width portion are the same. This reduces the excess of the plate material when the edges of the reduced width portion 23 are brought to face each other in the O-shape bending, and also inhibits the buckling in the large-diameter portion 11 caused by the inflow of the excess of the plate material.

(2b) The method of manufacturing the pipe 10 as described above allows to inhibit the occurrence of the buckling in the large-diameter portion 11; thus, the pipe 10 with a short reduced diameter portion 13 can be easily manufactured. Thus, for example, it is possible to manufacture a pipe 10 having a longer large-diameter portion 11 in proportion to the shortened length of the reduced diameter portion 13. Use of such pipe 10 enhances the design freedom of the attaching position of the framework bracket 2 to the instrument panel reinforcement 1, and thus, the framework bracket 2 can be formed into a shape with higher stiffness. This will be explained with reference to FIG. 1 and FIG. 12.

As one example shown in FIG. 1, the upper end of the framework bracket 2 is connected to a portion in the large-diameter portion 11 adjacent to the reduced diameter portion 13, and the lower end of the framework bracket 2 is fixed to an underbody of the vehicle.

Figure 12:
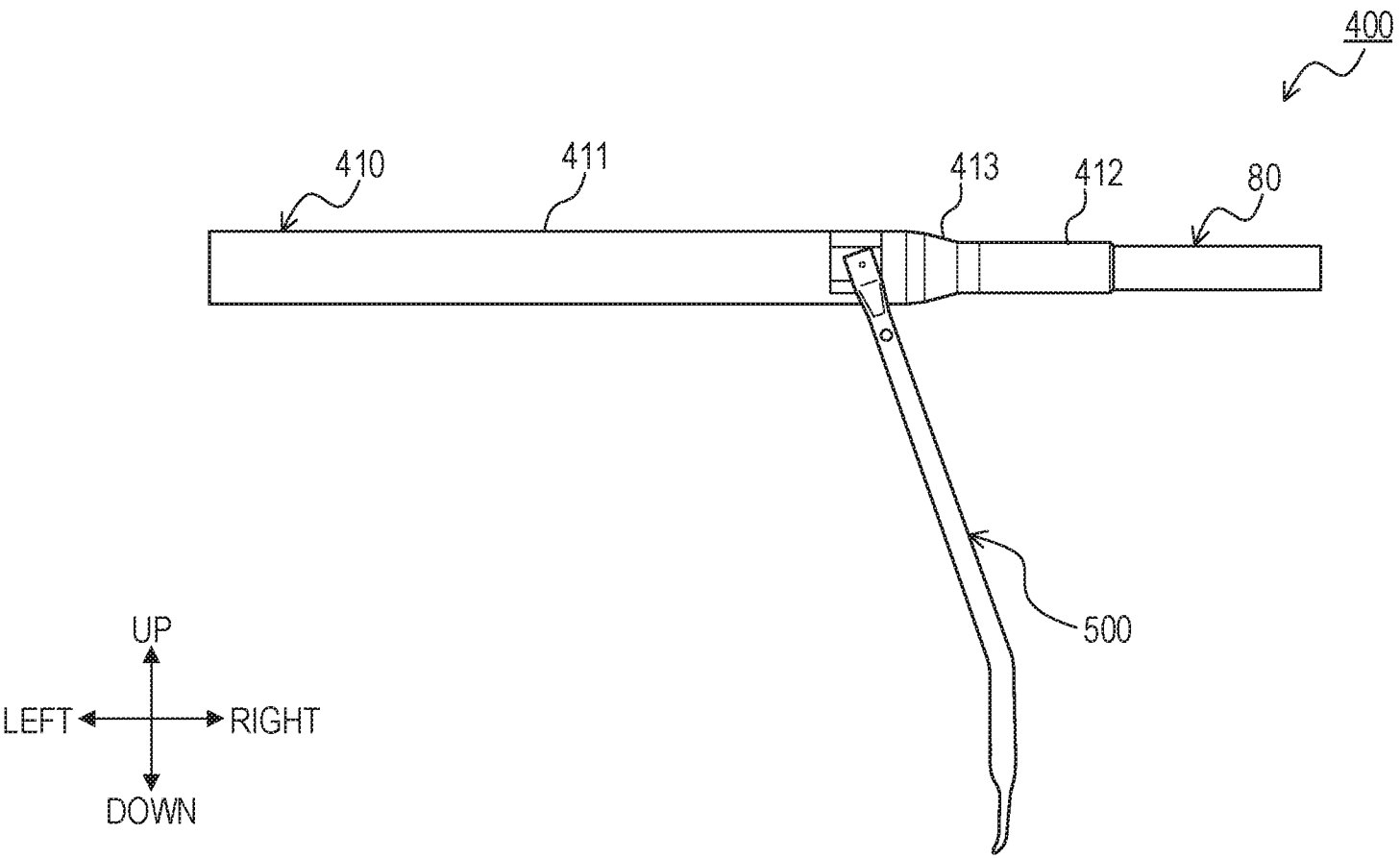
FIG. 12 is a front view showing a structure of an instrument panel reinforcement using a pipe according to a comparative example.

FIG. 12 is a view of an instrument panel reinforcement 400 arranged in a vehicle, as seen from a driver's side. The instrument panel reinforcement 400 is a comparative example. In FIG. 12, the right-left direction and the up-down direction of the vehicle is shown by arrows. The instrument panel reinforcement 400 is different from the instrument panel reinforcement 1 as one example of the present embodiment in that the instrument panel reinforcement 400 includes a pipe 410 instead of the pipe 10. The pipe 410 includes a large-diameter portion 411, a small-diameter portion 412, and a reduced diameter portion 413. The pipe 410 is different from the pipe 10 as one example of the present embodiment in that the reduced diameter portion 413 is longer than the reduced diameter portion 13 and the large-diameter portion 411 is shorter than the large-diameter portion 11. In other words, the pipe 10 has a longer large-diameter portion than the pipe 410 while maintaining the length of the small-diameter portion.

In the instrument panel reinforcement 400, the attaching position of the upper end of a framework bracket 500 and the fixing position of the lower end of the framework bracket 500 are widely separated in the right-left direction. Thus, the framework bracket 500 has to be bent to join the both ends of the framework bracket 500, which deteriorates stiffness. Here, in order to move the attaching position of the upper end of the framework bracket 500 to the right side, it is conceivable to shorten the small-diameter portion 412. However, shortening the small-diameter portion 412 is difficult due to the positional relationship of a component and the like attached to the small-diameter portion 412.

In contrast, as shown in FIG. 1, in the instrument panel reinforcement las one example of the present embodiment, the attaching position of the upper end of the framework bracket 2 is positioned closer to the right side compared to the instrument panel reinforcement 400 of the comparative example. In other words, in the instrument panel reinforcement 1, the fixing position of the upper end of the framework bracket 2 and the fixing position of the lower end of the framework bracket 2 are narrowly separated in the right-left direction. Thus, it is possible to join the both ends of the framework bracket 2 without bending the framework bracket 2 and the stiffness of the framework bracket 2 improves.

3. Other Embodiments

The description has been made of the embodiment of the present disclosure; however, it is understood that the present disclosure may not be limited to the above-described embodiment and may be modified in various modes within the technical scope of the present disclosure.

(3a) In the above-described embodiment, as a U-shape bending step to form a metal plate member into a U-shaped member, a step has been exemplified in which the U-shaped member 30 is formed by performing press molding one time on a flat metal plate member 20; however, the U-shape bending step is not limited to the above. For example, a metal plate member that is not flat at least in a portion, such as a metal plate member that is partially bent, may be used. Further, for example, the press molding may be performed several times until the metal plate member is formed into the U-shaped member. Still further, for example, some process other than press molding, such as cutting process, may be included until the metal plate member is formed into the U-shaped member.

Figure 13:
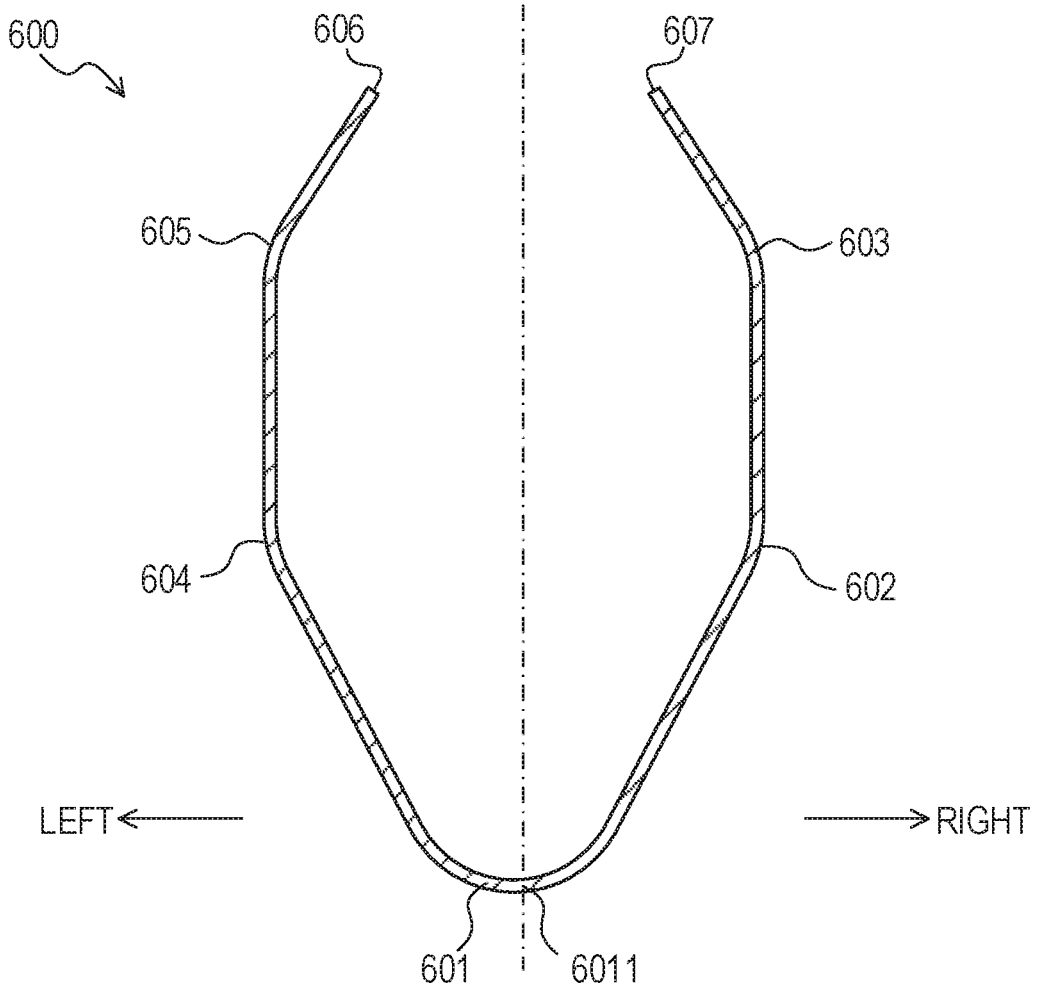
FIG. 13 is a sectional view of a U-shaped member having two or more curved portions in a U-shaped cross section.

(3b) In the above-described embodiment, the U-shaped member 30 has one curved portion 31 in the U-shaped cross section; however, the U-shaped member may have two or more curved portions in the U-shaped cross section. For example, a U-shaped member 600 shown in FIG. 13 has five curved portions 601, 602, 603, 604, 605 that are curved to swell outward the U-shaped cross section. The state of being "curved to swell outward the U-shaped cross section" means that the U-shaped cross section is curved so as to draw a circular arc with an arbitrary center point inside the U-shaped member 600. Specifically, as one of the curved portions, a center curved portion 601 is provided at the position facing the opening in the U-shaped cross section. In the U-shaped cross section, a virtual line passing through the bottom point 6011, which is positioned in the center curved portion 601 and is farthest from the opening, and the center of the opening is referred to as a center line of a U-shape. In FIG. 13, the center line of the U-shape is shown by a dash-dotted line. Also, one side of the center line of the U-shape is referred to as a right side, and the other side of the center line of the U-shape is referred to as a left side. On the right side of the center line of the U-shape, a right first curved portion 602 and a right second curved portion 603 are formed in this order from a position closer to the center curved portion 601. On the left side of the center line of the U-shape, a left first curved portion 604 and a left second curved portion 605 are formed in this order from a position closer to the center curved portion 601. The U-shaped cross section of the U-shaped member 600 has an approximately line-symmetric shape with the center line of the U-shape as an axis of symmetry. In addition, in the U-shaped member 600, the U-shaped cross section in the wide width portion and the U-shaped cross section in the narrow width portion have a substantially similarity shape.

A radius of curvature of each curved portion in the wide width portion is denoted as follows. A radius of curvature of the center curved portion 601 is R1, a radius of curvature of the right first curved portion 602 is R2, a radius of curvature of the right second curved portion 603 is R3, the radius of curvature of the left first curved portion 604 is R4, and a radius of curvature of the left second curved portion 605 is R5. Also, a radius of curvature of each curved portion in the narrow width portion is denoted as follows. A radius of curvature of the center curved portion 601 is R6, a radius of curvature of the right first curved portion 602 is R7, a radius of curvature of the right second curved portion 603 is R8, a radius of curvature of the left first curved portion 604 is R9, and a radius of curvature of the left second curved portion 605 is R10.

In this case, in all the curved portions in the wide width portion and the narrow width portion, when the radius of curvature in the narrow width portion is equal to or more than the corresponding radius of curvature of the wide width portion, the opening degree of the two side walls in the narrow width portion is larger than the opening degree of the two side walls in the wide width portion. Specifically, the above is the case where $R1 \leq R6$, $R2 \leq R7$, $R3 \leq R8$, $R4 \leq R9$, and $R5 \leq R10$. However, a case is excluded where all the corresponding curved portions have the same radius of curvature.

When the U-shaped cross section in the wide width portion and the U-shaped cross section in the narrow width portion have a substantially similarity shape, the opening degree of the two side walls may be determined by an angle formed by two line segments; one line segment connects an end point 606 and the bottom point 6011, and the other line segment connects an end point 607 and the bottom point 6011, in the U-shaped cross section. Then, the opening degree of the two side walls in the wide width portion and the opening degree of the two side walls in the narrow width portion may be compared by the angle formed in the wide width portion and the angle formed in the narrow width portion.

(3c) In the above-described embodiment, the pipe 10 is manufactured by the UO bending method in which one metal plate member 20 is press-molded. Thus, the entire portions of the pipe 10 are made of the same metal material. However, the pipe 10 may be made of two or more materials. For example, in the pipe 10, a part of the large-diameter portion 11 (for example, a portion apart from the reduced diameter portion 13 by a predetermined distance or more) may be made of a material different from other portions.

(3d) In the above-described embodiment, the pipe 10 has a uniform thickness; however, the pipe 10 may not have the uniform thickness. For example, in the pipe 10, a part of the large-diameter portion 11 (for example, a portion apart from the reduced diameter portion 13 by a predetermined distance or more) may be thicker than other portions.

(3e) In the above-described embodiment, the sectional shape of the pipe 10 is a perfect circle; however, the sectional shape of the pipe 10 may not be limited by this. For example, the sectional shape of the pipe 10 may be an oval.

(3f) In the above-described embodiment, the pipe 10 is a concentric pipe; however, the pipe 10 may be an eccentric pipe. The eccentric pipe is a pipe in which the central axes of the large-diameter portion 11, the small-diameter portion 12 and the reduced diameter portion 13 are not positioned on the same straight line.

(3g) The UO bending method in the above-described embodiment is one of the examples. For example, the edge bending step may not be included.

(3h) On the outer surface of the pipe 10 of the above-described embodiment, a flat surface may be formed. The flat surface is, for example, a portion where a component attached to the instrument panel reinforcement 1 is connected. The size and the number of the flat surface may be optionally designed.

(3i) In the above-described embodiment, the pipe 10 to be used for the instrument panel reinforcement 1 is described; however, the pipe may be used for other use.

(3j) Two or more functions of one element in the above-described embodiments may be achieved by two or more elements; and one function of one element in the above-described embodiments may be achieved by two or more elements. Two or more functions of two or more elements in the above-described embodiments may be achieved by one element; one function of two or more elements in the above embodiments may be achieved by one element. A part of the configuration of the above embodiments may be omitted. At least a part of the configuration of the above embodiments may be added to or replaced with another configuration of the above-described embodiments.

What is claimed is:

1. A method of manufacturing a pipe including a large-diameter portion, a small-diameter portion, and a reduced diameter portion connecting the large-diameter portion and the small-diameter portion, the method comprising:

forming a metal plate member into a U-shaped member having a U-shaped cross section, the metal plate member including a wide width portion, a narrow width portion having a plate width shorter than a plate width of the wide width portion, and a reduced width portion having a plate width that varies to connect the wide width portion and the narrow width portion, the U-shaped member including a curved portion facing an opening between two edges of the U-shaped cross section, and two facing side walls continued from the curved portion;

inwardly inclining and bending the two edges of the U-shaped member; and forming the U-shaped member into a shape of the pipe by forming the wide width portion, the narrow width portion, and the reduced width portion into a shape of the large-diameter portion, a shape of the small-diameter portion, and the reduced diameter portion, respectively, wherein in the U-shaped member an opening degree of the two facing side walls in at least part of the narrow width portion is larger than an opening degree of the two facing side walls in at least part of the wide width portion.

2. The method of manufacturing the pipe according to claim 1, wherein in the U-shaped member, the two facing side walls are flat in the portion having a U-shape that corresponds to the narrow width portion and in the portion having a U-shape that corresponds to the wide width portion.

* * * * *